United States Patent [19]

Geisler

[11] 4,196,479

[45] Apr. 8, 1980

[54] STEAM ENCLOSING BATH COVER

[75] Inventor: Neville Geisler, Ilford, England

[73] Assignee: Danton Domestic Appliances Inter'l Ltd., London, England

[21] Appl. No.: 921,831

[22] Filed: Jul. 3, 1978

[51] Int. Cl.[2] ..... A61H 33/10; A61H 33/12

[52] U.S. Cl. ..... 4/162; 4/160

[58] Field of Search ..... 4/160, 162, 163, 161, 4/164, 165; 128/293, 373

[56] References Cited

U.S. PATENT DOCUMENTS

| | | | |
|---|---|---|---|
| 1,948,204 | 2/1934 | Dillard | 4/162 |
| 2,095,749 | 10/1937 | Kellner | 4/162 |
| 2,541,029 | 2/1951 | Burton | 4/162 |
| 3,119,122 | 1/1964 | Weisbeck | 4/162 |
| 3,375,534 | 4/1968 | Vieceli | 4/162 |
| 3,581,315 | 6/1971 | Milliner | 4/162 |
| 3,611,448 | 10/1971 | Dudley | 4/162 |
| 3,837,014 | 9/1974 | Sugiyama | 4/160 X |
| 3,961,380 | 6/1976 | Garr | 4/162 X |

FOREIGN PATENT DOCUMENTS

| | | | |
|---|---|---|---|
| 290052 | 5/1928 | United Kingdom | 4/162 |

*Primary Examiner*—Henry K. Artis

*Attorney, Agent, or Firm*—Browdy and Neimark

[57] ABSTRACT

A steam enclosing bath cover apparatus suitable for employment in the provision of Turkish or other sweat bath conditions in the home comprises an elongate container for securely positioning at a suitable location on a bath. Housed in the container is flexible elongate sheet material of water impervious nature which may be withdrawn from the container over a bather in a bath containing hot water. The sheet has an opening which may be pulled over the head of the bather. The container contains means for allowing ready return of the sheet material thereinto so as to be in a form ready for subsequent withdrawal and use.

10 Claims, 15 Drawing Figures

STEAM ENCLOSING BATH COVER

This invention relates to a steam enclosing bath cover and to baths comprising the same.

For persons wishing to take a steam bath, it has hitherto generally been necessary for them to pay visits to Turkish and like baths. Clearly this is an inconvenient procedure and in many cases it is desirable for baths of such type to be taken in the home.

A number of arrangements have hitherto been disclosed for enabling steam baths to be taken at home. For example, German Pat. Nos. 99308 and 107582 describe special domestic steam baths which take the form of cabinets having associated water supply and in the bottom of which water is to lie. In an upper region of the cabinet is provided a hammock type of arrangement on which the bather is to lie, with the cabinet being covered over almost entirely but for the provision of an aperture of sufficient size to enable the patient's head to extend out of the cabinet. Such an arrangement is basically unsatisfactory for use in the modern home where space for such an arrangement is unavailable. A conventional modern bath cannot conveniently be adapted for use in this manner since its depth will be insufficient to allow a body of water to be housed in the bottom thereof and the bather to lie on a hammock thereafter with his body substantially within the bath. The canopy itself will, in addition, require suitable fixing points which will require modification of a bath and/or bathroom.

These arrangements are in fact more akin to the so-called sweat boxes an example of which is disclosed in U.S. Pat. No. 2,346,827. As an alternative thereto, arrangements have hitherto been described for allowing the conversion of a conventional bathtub into a steam bath. One such arrangement is described in German Pat. No. 443,294 and is generally only suitable for use with baths which stand away from walls extending lengthwise thereof. The arrangement comprises a support structure for positioning at one end of the bath and a seat suspended from the sides of the bath so that the bather may sit within the bath with his head extending from the support structure. However, although this is a sweat bath it is not intended to be used as a steam bath and heat for the subject when enclosed under the cover is provided by electrical heating devices.

A device for adapting an existing domestic bathtub for use as a dry hot air bath of the type forming the subject of German Pat. No. 443,294 or for use as a steam bath is described in U.S. Pat. No. 3,837,014. This device comprises a base framework for fitting around the edge of a bath thereby precluding the use of a bath when installed adjacent a bathroom wall. A detachable cover member is positioned over the framework and the end plate and has openings adjacent the opposite end thereof, one being for receiving a user's head and the other of which is for detachably mounting a heater. A slide fastener extends lengthwise of the cover to allow the bather to enter and leave the bath when the fastener is open. An arrangement of this type is aesthetically unpleasing in a bathroom where aesthetic appeal is a major factor in the planning thereof. Moreover, the cover is difficult to enter since even when the slide fastener is open, the available aperture is relatively narrow and the slide fastener will scratch the body of the bather.

It is an object of this invention to provide a bath with a steam enclosing bath cover which may remain permanently over the bath without hindering the entry of persons into the bath for normal bathing purposes.

It is another object of this invention to provide a steam enclosing bath cover which can be removably fixed over a bath for enabling a steam bath to be taken therein.

It is a further object of the invention to provide a steam enclosing bath cover which whenever disposed over a bath and not in use for steam bathing purposes may blend aesthetically with the bath and its surrounds.

According to the present invention, there is provided a steam enclosing bath cover which comprises an elongate container adapted at its opposite ends to lie on the sides of a bath, an elongate opening in the container extending lengthwise of the container, an elongate sheet of a water impervious material housed within the container and having a width substantially equal to the length of the container, means for withdrawing said elongate sheet from the container through the elongate opening and for returning it thereinto, an opening in said elongate sheet for enabling the head, at least, of a bather to extend through the elongate sheet, which elongate sheet is adopted so as to adopt, when withdrawing from the container, a stable position in relation to the bath whereby steam from the bath is substantially retained thereunder.

The container can either by manufactured as a separate item to be employed over a bath of suitable size, or can be built into the bath at the time of manufacture thereof. In the latter case, the container is preferably mounted on runners extending along the side of a bath. If the bath is formed of reinforced synthetic plastics material, such runners can be readily formed in the moulding process in which the bath is made. Alternatively, runners made of for example synthetic plastics material or extruded metal strip can be secured to any type of bath. In this way, the container can be slid to and fro along the length of the bath, allowing in particular a bather to have ready access to the interior without the risk of impedance by the container.

A preferred steam enclosing bath cover embodying the present invention is one which can simply be placed over the top of a bath preferably in a central region thereof so that the cover can be withdrawn therefrom when required to cover the bath. When the cover is positioned in a central region of the bath, two sections of cover will generally be provide, each having its own withdrawal means. A particularly preferred steam enclosing bath cover of this type is one which combines the function of a steam cover with that of a soap tray. The top of the container can then be suitably formed with recesses for soap and other bathing requirements. In such a case, it will be essential for the container to be normally positioned in the central part of the bath. A particular advantage of an arrangement in which two elongate sheets of water impermeable material each of which can be independently removed from the container and replaced therein and at least one of which is formed with a head opening is that it allows one half of the bath to be covered while the other half remains uncovered. In this way, washing operations carried out by the bather will not be hindered by a container centrally emplaced over the bath from the outset with one of the elongate sheets already extended. When the bather is ready to subject himself to steam conditions, even if at the outset of bathing, he only then needs to sit at one end of the bath and pull forwards and over his head the other elongate sheet which will be relatively close to hand.

The elongate sheet or sheets of water impermeable material employed to form a cover for the bath are preferably mounted on rollers carried within the container and a release one way clutch, preferably ratchet mechanism, preferably being provided for effecting rotation of the or each roller as the or each elongate sheet is withdrawn therefrom and for returning the elongate sheet to the container when subject to tension to relase the clutch. The elongate sheets providing a cover over the bath are preferably made of synthetic plastics material of sufficient strength to withstand the necessary tension therein when repeatedly withdrawn from the container. Accordingly, they can be formed of synthetic plastics material of suitable gauge or of fabric reinforced synthetic plastics material. A particularly suitable material is woven polyamide fabric especially nylon fabric, of the type frequently used in shower curtain manufacture.

In order that the or each elongate sheet should retain its desired position in the bath, means may be provided for attaching the free edges thereof to the side of the bath. Clamping means can be provided for this purpose or for simplicity of operation, suction members may be employed. In order to achieve a particularly good steam seal, such fixing arrangements can be disposed at intervals along the sides of the elongate sheet or sheets. However, this will render the elongate sheet or sheets somewhat bulky when stored within the container and it is preferable that the sheets be simply reinforced across their widths by metal and or plastics or other substantially rigid strips so that when extended and such strips are laid on the rim of the bath, the sheets will show minimal tendency to sag and remain in close association with the rim of the bath so that steam is effectively retained therein. Alternatively, or additionally, the sheets can be reinforced at their edges. For this purpose, the edges of the elongate sheet or sheets can carry a row of plastics elements which, when the sheet or sheets are pulled out from the container interengage in a snap fitting manner to form a rigid edge. This engagement will be broken when the sheet or sheets are withdrawn into the container.

The container itself can be made of wood or metal. However, particularly, having regard to its potential secondary function as a soap tray or rack, it is preferably formed of synthetic plastics material, for example polyethylene, which can be pigmented in a variety of colours to match the available bath colours. Alternative materials which may be made to match available bath colours are enamel-covered steel and vitreous porcelain. Although a slot may be provided for the removal of the or each elongate sheet from the container, such a slot may need to be of substantial width if an elongate sheet modified as aforesaid is to be withdrawn from the container and yet prevent an aesthetically unsatisfactory view of the contents of the container when the bath cover is not in use. Accordingly, in such a case, when the bath cover is not in use, the container is preferably closed at the side or sides from which emerge the sheets by means of elongate side panels hinged at the bottom edges to the base of the container and connectable at their upper edges to the container by for example, snap fastening means. To prevent the contents of the container from being visible when the cover is in use, a flap can hang down from an upper edge thereof so as not to impede withdrawal of the elongate sheet(s). Such a flap can optionally carry a mirror or mirrors.

In order that the container when displaceable along the length of the bath or when manufactured as a separate item should remain in place during use thereof, particularly when pulling the elongate sheet or sheets of water impermeable material out therefrom, means is preferably provided for fixing the container in place. A particularly simple form of such fixing means is constituted by a pair of oppositely directed suction member-terminated rods connected to each other by means of a tension spring. When the container is not in use, the suction members will be in a retracted position thereby allowing removal of the container from its usual position of use. When the container is to be used, the suction member-carrying rods can simply be forced apart until the suction members grip the sides of the bath. It is preferable that the rods be locked in this position. This may simply be achieved by providing suitable recesses in the container and associated projecting members of the rods whereby in a first orientation, the rods are capable of displacement in their lengthwise direction and when turned through a prescribed angle when in an extended position, the projecting members will enter recesses and thus ensure that the rods remain in their displaced positions.

In an alternative arrangement for holding the container in position and which is readily adaptable irrespective of the internal width of the bath, the container comprises on the underside of the container a track arrangement extending lengthwise thereof and holding thereon a pair of flaps, which flaps are capable of reciprocating motion along said tracks and comprises suction means on faces thereof which are, in use, directed towards the sides of a bath. The flaps preferably carry resilient biasing means for constraining them to lie against the underside of the container and are adapted for rotation each about a horizontal axis with respect to the underside of the container against the tension in the spring to bring the suction means into engagement with the sides of the bath.

For a better understanding of the invention, and to show how the same can be carried into effect, reference will now be made, by way of example only, to the accompanying drawing, in which.

Figure 6:
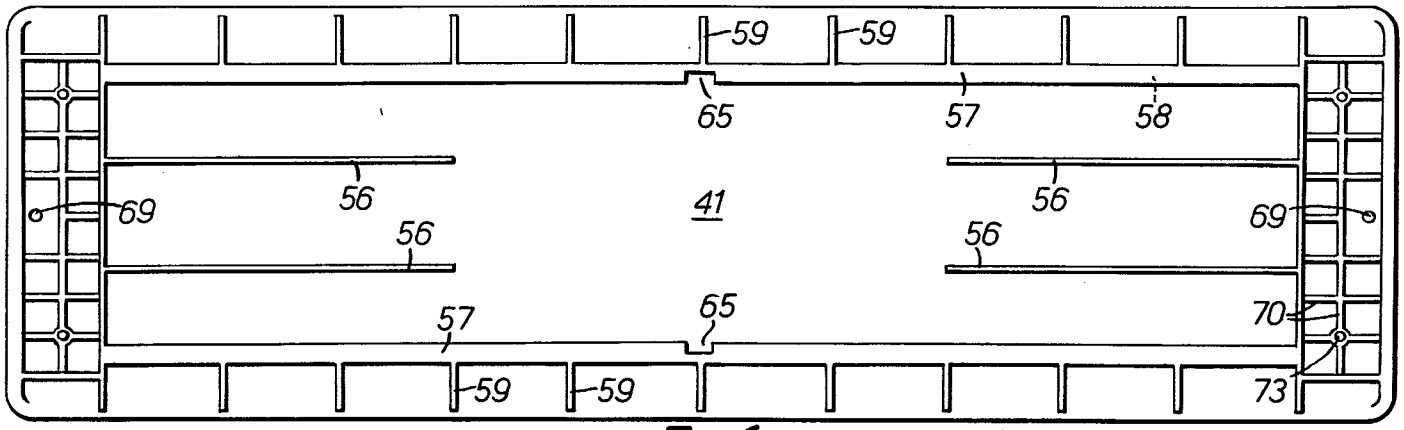
FIG. 6 is an underside plan view of an alternative form of container of a steam enclosing bath cover embodying this invention.
Figure 7:
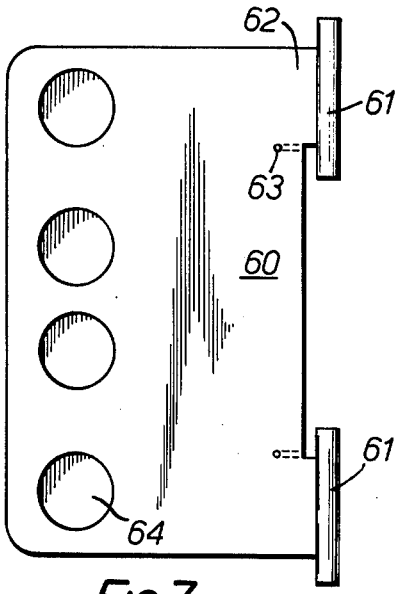
FIGS. 7 and 8 are upper and lower plan views of a container securing flap for a container whose underside is shown in FIG. 6.
Figure 8:
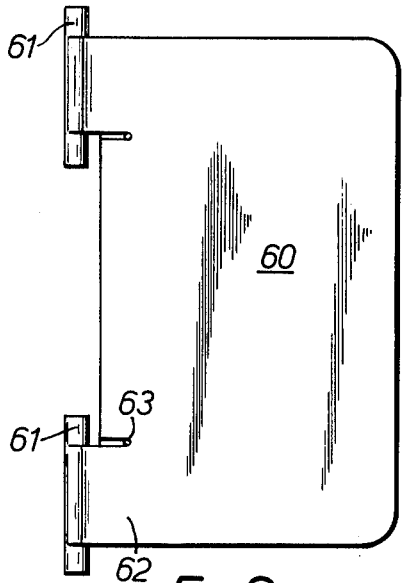
Figure 9:
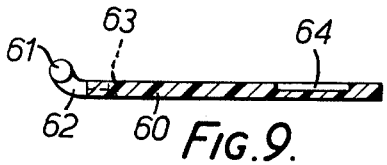
FIG. 9 is a transverse cross-section through the flap of FIGS. 7 and 8 taken at IX—IX in FIG. 8.
Figure 10A:
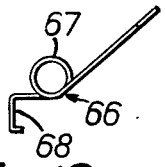
Figure 10B:
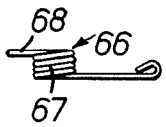
Figure 11:
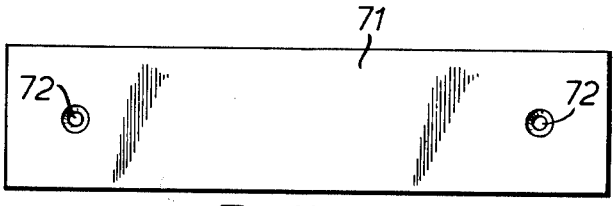
Figure 12:
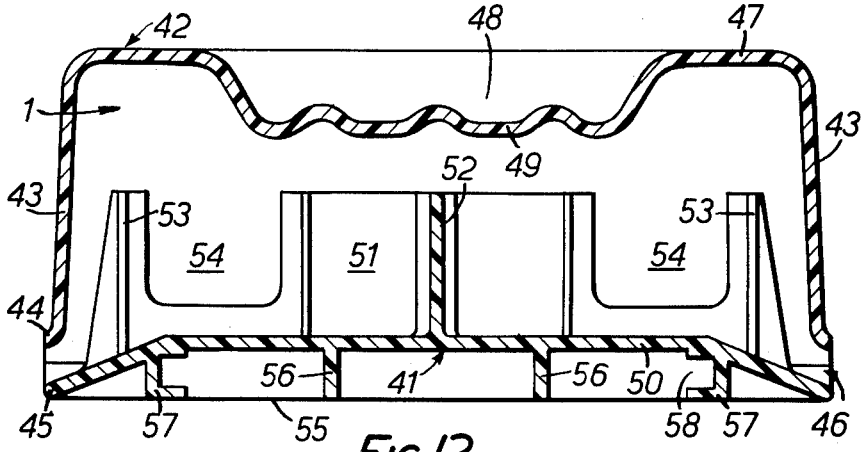
Figure 13:
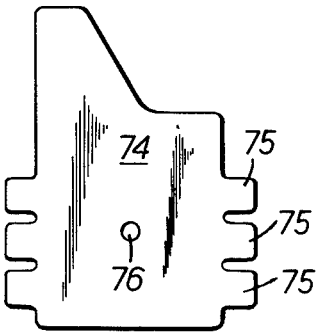
Figure 14:
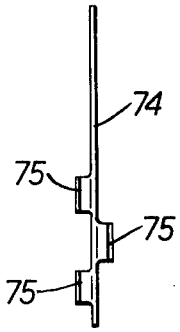

FIGS. 10*a* and 10*b* are views taken at right angles to each other of a spring member for use with a flap as shown in FIGS. 7 to 9;

FIG. 11 is a plan view of a suction pad support plate for attachment to the container underside shown in FIG. 6;

FIG. 12 is a transverse cross-section through a container whose underside is shown in FIG. 6 and which is provided with a cover; and FIGS. 13 and 14 are respectively a face elevation and an end elevation of a roller support plate for use in the arrangement shown in FIG. 12.

Figure 1:
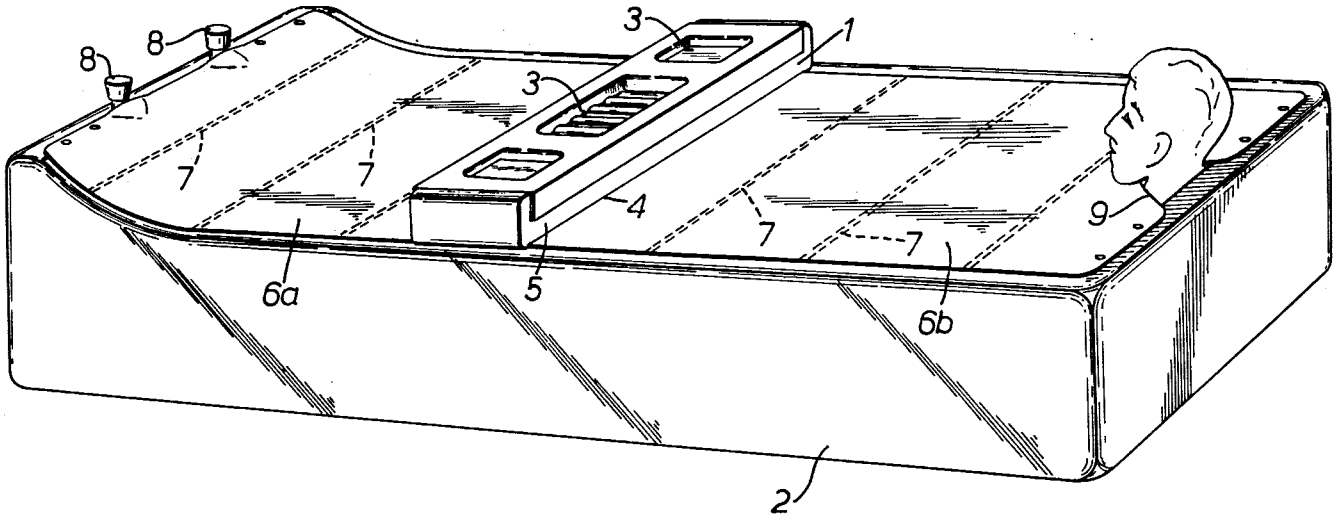
FIG. 1 is a perspective view of a steam enclosing bath cover according to the present invention emplaced on and in use on a bath.

Referring first to FIG. 1, the steam enclosing bath cover comprises a container 1 laid over a bath 2 and formed with recesses 3 on a top surface so that it can function as a soap tray. Extending from slots 4 at the lower part of sidewalls 5 of the container are a pair of elongate sheets 6*a* and 6*b* formed of water impermeable material, for example plastics material of the gauge used in the manufacture of shower curtains and whose free end regions are shaped in accordance with the shape of the ends of the interior of the bath. The sheets each possess reinforcements 7 constituted by metal strips which impart rigidity to the extended sheets and thereby assist in preventing the escape of steam from the interior of the bath as a result of sag of the sheets. The sheets have an outer strip of foamed material attached thereto to enhance the steam seal. At their free ends, the elongate sheets are attached to the bath end. The sheet numbered 6*a* which is drawn from the container in a direction away from the taps 8 of the bath is formed with an aperture 9 for enabling the head of the bather to extend therethrough. This aperture can either be formed as a hole cut in the material of the sheet 6*a* or is alternatively a slit suitably dimensioned to allow the sheet to be drawn over the head to rest on the shoulders of the bather. If the sheet 6*a* is formed of a particularly flexible plastics material, then it is conceivable that the aperture 8 may be formed as a slit so dimensioned to allow part of the torso to extend therethrough. This will have a particular advantage in allowing the hands to be withdrawn from beneath the steam cover to allow the bather, for example, to read a book while laying in the bath and yet to enable the greater part of his body to remain under the steam cover.

Figure 2:
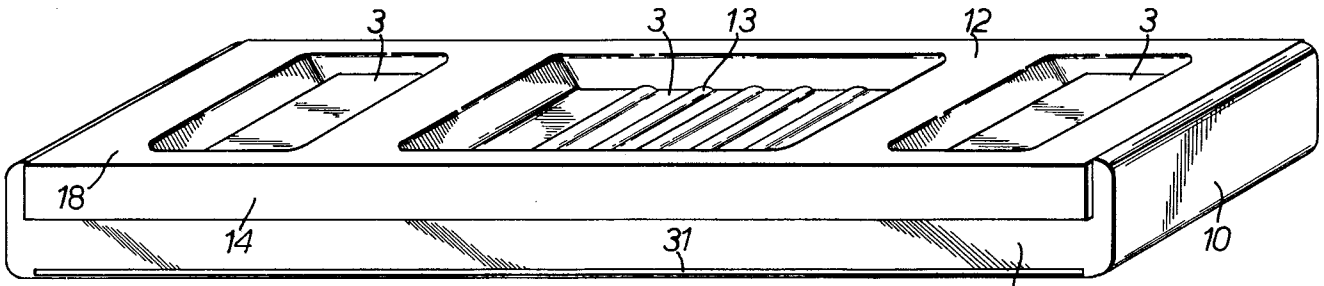
FIG. 2 is a perspective view to a larger scale than that shown in FIG. 1 and showing portions of the interior thereof, of a container of a steam enclosing bath cover embodying this invention.
Figure 3:
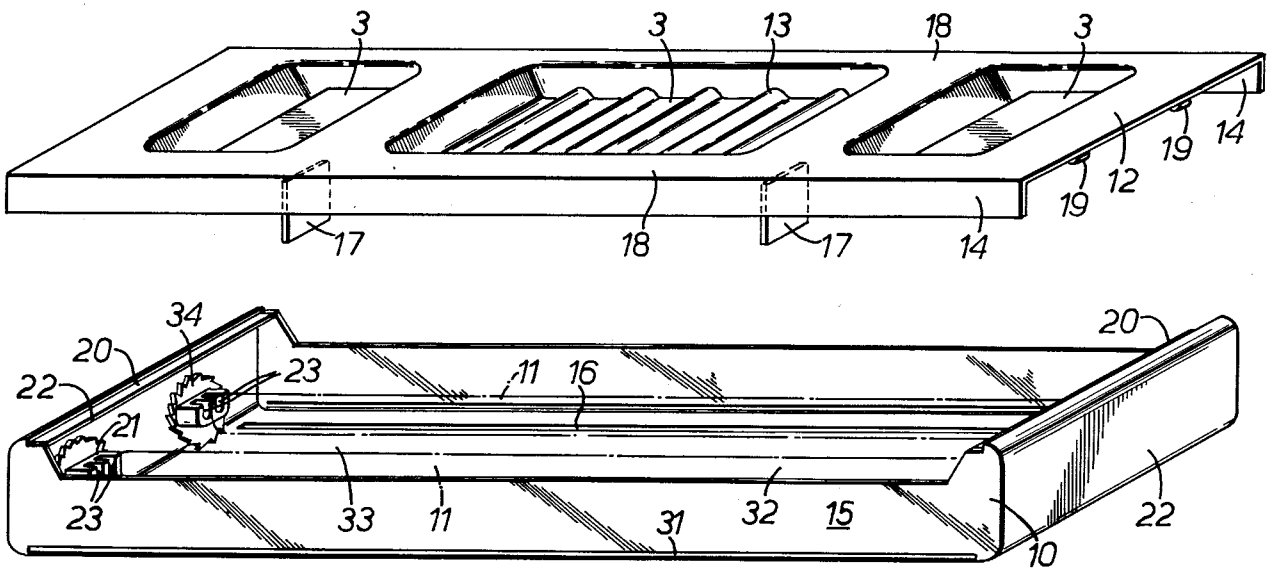
FIG. 3 is an exploded view of the main component elements of the container of FIG. 2.

Referring next to FIGS. 2 and 3 of the drawings, it can be seen that the container 1 is formed in two parts, namely a housing 10 for a pair of rollers 11 (see FIG. 3) and a cover 12 formed with the aforesaid recesses 3 for soap etc. The parts 10 and 11 are formed as plastics mouldings and in this way, the cover 12 is readily given the complicated form illustrated with corrugations 13 for the draining of soap. The cover 12 comprises side sections 14 which in the assembled container (FIG. 2) lie parallel to a sidewall 15 of the lower part of the container, which comprises at a lower part a slot 31 for the withdrawal of the elongate sheets of water impermeable material. The cover 12 is additionally formed with reinforcing members 17 which impart rigidity to the cover in the region of the longitudinally extending edges 18. The cover 12 is formed at each end with a pair of lugs 19 which clip under ledges 20 extending along the upper transverse marginal regions of the housing of the container. Thus, when the soap tray is fitted on the housing of the container, a smooth surface transition therebetween occurs and the sidewalls of the upper part of the container are completed as a result of the side sections of the cover 12 covering cut-out sections 32 in the sidewalls 15 of the lower part of the container. An alternative way of providing the soap tray on the container and simultaneously forming the sidewalls 15 would be for the sidewalls 15 to be integral with the cover as a result of deepening of the side sections 14 which will then enter vertical channels at the corners of the lower part of the container.

Slots 16 are provided in the base wall 33 of the lower part of the container, these serving to receive rubber or plastics foam blades or strips for removing surplus water from the surface of the elongate sheets being withdrawn into the container after use.

A pair of supporting members 21 for the rollers 11 is secured to each end wall of the lower part of the container. These holding members comprise a pair of channels 23 for receiving corresponding projecting members (not shown) in the ends of the rollers 11. The holding members 21 are mounted in a ratchet wheel 23 so as to provide a ratchet mechanism whereby the elongate sheets of water resistant material can be freely withdrawn from the rollers 11 and readily withdrawn into the container on freeing of the ratchet mechanism.

Figure 4:
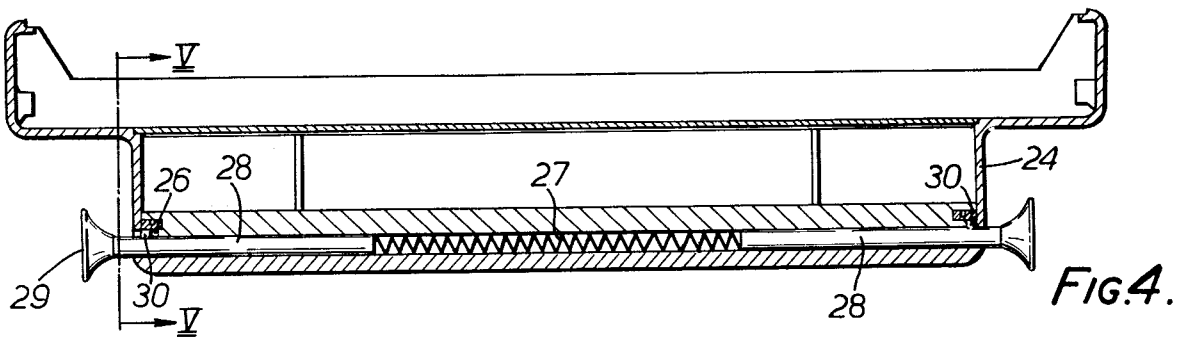
FIG. 4 is a longitudinal section through the container of FIGS. 2 and 3.
Figure 5:
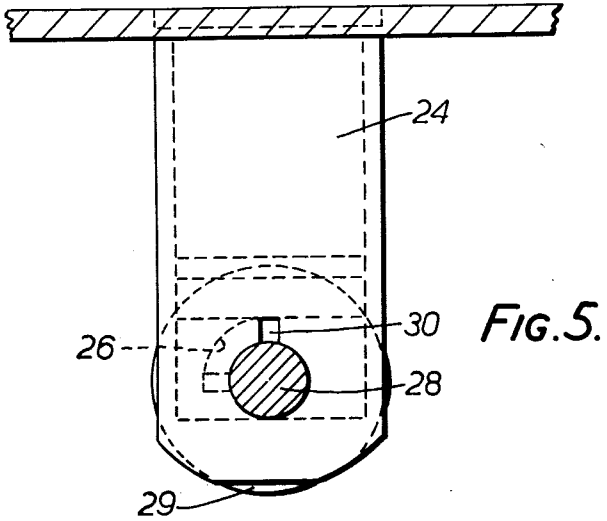
FIG. 5 is a transverse cross-section through part of the container of FIGS. 2 and 3.

Referring next to FIGS. 4 and 5 of the drawings, only the housing 10 of the container is shown here. It can be seen from FIG. 4 that the housing 10 of the container surmounts a lower fixing assembly 24 which cannot be seen in FIGS. 2 and 3. The lower fixing assembly 24 comprises a bar 25 having a pair of recesses at the ends thereof and carrying a tension spring 27 which is attached at each end to a rod 28 carrying at the outer end thereof a suction member 29. The rods 28 are shown in the positions which they will occupy when the container is fixed in place on a bath with the suction members 29 gripping the lateral walls thereof. In this condition, projecting members 30 extend into the recesses 26 so as to hold the rods in position. To release the holding of the container in the bath, it is simply necessary to turn the rods 28 through 90° to remove the projecting members 30 from the recesses 26 and allow the rods 28 to be retracted under the force of the spring 27. The recess 26 in the righthand part of FIG. 4 is only large enough to accommodate the projecting member 30 associated therewith. Such an arrangement will be employed particularly when the container is made for a particular model of bath, perhaps as a component part thereof mounted on runners as mentioned hereinabove. The lefthand part of FIG. 4 shows the recess to be larger than required to accommodate the projecting member 30. In this way, it is possible to utilise a single design of container 1 with a variety of models of bath of similar but not identical transverse dimensions. When fixed in place, the projections 30 will extend along the recess 26 as far as is permitted by the internal width of the bath.

Referring next to FIG. 5, a transverse section through the lower part of the housing 10 of the container 1, this being the part shown in detail in FIG. 4, is here indicated. This Figure shows the provision of the projecting member 30 on a rod 28 and the manner in which it can be rotated through 90° to take it into and out of engagement with the recess 26.

Referring next to FIGS. 6 and 12 of the drawings, the casing of an alternative container 1 according to this invention can be seen to comprise a base 41 and a cover 42 comprising walls 43 extending lengthwise thereof and having flared lips 44 which with lips 45 of the base form an elongate slot 46. At its upper wall 47, the cover 42 is formed with a number of depressions 48 having corrugated bases 49 so that the depressions may conveniently be employed for the carrying of soap. It will be appreciated from FIG. 12 that the cover is essentially a rectilinear box lacking one side (the base) and having no function basically other than to provide a cover for the base 41.

As can be seen from FIG. 12, the base 41 comprises a floor 50, upstanding end walls 51 of which only one is visible and a central wall 52 extending lengthwise thereof between the end walls. Reinforcing flanges 53 serve to support the end walls at the lateral margins thereof. Each end wall 51 is formed with a pair of cut-outs 54 positioned one on either side of the central wall 52. The floor 50 lies above a base plane 55 to which extend a number of ribs extending lengthwise of the underside of the floor. As can be seen from FIG. 6, these ribs are constituted by pairs of ribs 56 extending half of the length of the floor 50 and flanked by bent over ribs 57 extending the entire length of the floor and defining channels 58 therein. Beyond the bent over ribs 57, the floor 50 slopes downwardly to the base plane 55 and is provided with transversely extending reinforcing flanges 59 (see FIG. 6).

Referring next to FIGS. 7 to 9, there are shown views of a flap to be employed below the floor 50 of the base 41 for enabling the container of FIGS. 6 and 12 to be positioned reliably over a bath in accordance with the bath interior width. Two flaps 60 are to be employed each to be associated with a pair of ribs 56 and channels 58 thereadjacent. The flaps are of substantially rectangular form being provided with cylindrical rods 61 formed integrally with flanges 62 at outer marginal regions thereof. Small holes 63 whose function will be described hereinafter are positioned in the flaps adjacent the flanges 62. Depressions 64 are formed on the underside of the flaps 60 to house suction pads (not shown) which can be fixed either by use of adhesive or by press fitting. The flaps 60 are introduced into and suspended from the floor 50 of the container by first passing the outer ends of the cylindrical ribs 61 through cut-outs 65 in the bent over ribs 57 so that they enter the channels 58. The flaps can then be slid between the adjacent ribs 56 and 57 towards the outer ends of the floor. The flaps are normally constrained to lie against the underside of the floor 50 by means of springs 66 which are shown in FIGS. 10*a* and 10*b* and which possess a helical spring part 67 which is passed over the inner ends of the cylindrical rods 61 while projections 68 thereof pass through the holes 63 in the flaps. When it is required to fix the container on a bath, the flaps which are provided with their cylindrical rods 61 at end margins adjacent the outer ends of the floor and with the aforesaid suction pads on their underside are bent downwardly against the force of the spring 67 and held by the suction pads on the side of the bath. When it is required to take off the container, the flaps are simply pulled away and then are forced back to lie parallel to the floor of the container under the action of the spring 67.

Fixing of the base 41 to the cover 42 of the container is achieved simply by means of screws passing through screw holes 69 in the floor of the base 41 to enter corresponding bores in the end walls of the cover 42. The screw holes 69 are provided in a portion of the floor 50 formed with reinforcing ribs 70 and which portion is intended to be covered in use by means of a plate 71 shown in FIG. 11 by means of screws passing through screw holes 72 in the plate 71 to enter bores 73 in the floor of the base. The plate 71 will be provided with suction pads in order to keep the container steady on the edges of the bath.

Finally, turning to FIGS. 13 and 14 of the drawings, holding plates 74 are employed in the cut-outs 54 in the end walls 51 of the base 41. These will generally be formed of metal and have flanges 75 along the upstanding edges thereof which, as can be seen in FIG. 14 are bent out of planarity, alternating flanges being bent in different directions so that the plate 74 will remain in the cut-outs 54 when slid over the margins thereof. The flanges 74 are formed with central apertures 76 which are to be engaged by end projections of roller blind rollers having ratchet mechanisms therein and which will have elongate sheets or water impermeable material wrapped therearound. The form of the elongate sheets will be that of the sheets 6*a* and 6*b* shown in FIG. 1 and because of their conventional form, the roller blind rollers are not shown in the drawings in the interests particularly of clarity. When the casing is assembled with its rollers in position between holding plates 74 at opposite ends of the casing, the elongate sheets may be pulled out therefrom in a manner analogous to that described above with reference to FIGS. 2 to 5 and used to provide a steam enclosing bath cover.

A steam enclosing bath cover according to this invention can be used to reduce considerably the rate of cooling of bath water, and, while the bath remains sufficiently hot, to provide a steam atmosphere between the bath water and the cover thereby to provide many of the beneficial effects of steam baths.

I claim:

1. A steam enclosing bath cover apparatus for positioning on an elongate bath to span longitudinally extending upper margins thereof at a position intermediate the ends thereof, the apparatus serving additionally as a means for carrying soap and/or other materials used in bathing, which apparatus comprises an elongage container adapted at its opposite ends to lie on the sides of a bath, which container comprises an upper wall member formed with depressions whereby the container may carry thereon soap and/or other materials used in bathing, a pair of elongate openings in opposed wall regions of the container extending lengthwise of the container and having a width equal at least to the width of the bath, two flexible elongate sheets having parallel lateral edges of a steam impervious material housed within the container and having a width substantially equal to the length of the opening, which sheets are so housed in the container as to allow their withdrawal lengthwise therefrom, one from each said elongate opening, and having associated means for effecting return of the elongate sheets into the container, and means providing an opening in one said elongate sheet for enabling the head, at least, of a bather to extend through one said elongate sheet, which elongate sheet is adapted so as to adopt, when withdrawn from the elongate container, a stable position in relation to the bath whereby steam provided in use of the bath by hot water therein is substantially retained under the elongate sheet.

2. A steam enclosing bath cover apparatus as claimed in claim 1, wherein said elongate openings are provided in respective lateral side walls of the container.

3. A steam enclosing bath cover apparatus as claimed in claim 1, wherein said elongate sheets are roller mounted, the rollers having an associated one way clutch mechanism for allowing rotation of the rollers as said elongate sheets are withdrawn therefrom and out of said elongate openings and for effecting reverse rotation of the rollers to achieve return of the sheets to the container when the elongate sheets are subject to tension to release the clutch.

4. A steam enclosing bath cover apparatus as claimed in claim 3, wherein the one way clutch mechanism is a ratchet mechanism.

5. A steam enclosing bath cover apparatus as claimed in claim 1, wherein the elongate sheets comprise a plurality of transversely extending substantially rigid reinforcing members disposed at intervals along the length thereof.

6. A steam enclosing bath cover apparatus as claimed in claim 1, wherein the elongate container carries on its underside fixing means for engaging the sides of a said bath for holding the container in a desired position on said bath.

7. A steam enclosing bath cover apparatus as claimed in claim 6, wherein the fixing means comprises a pair of oppositely directed suction member-terminated rods connected to each other by a helical spring member and having associated means for constraining said helical spring member to remain in an extended state when the container is to be held in said position.

8. A steam enclosing bath cover apparatus as claimed in claim 7, wherein means provided recesses are disposed on the underside of the container and said rods are formed with complementary projections thereon which, when in a first orientation allow displacement of the rods in their longitudinal direction and which, when in a second orientation achieved by rotation of the rods so that the projections enter said recesses, serve to prevent displacement of the rods and hold the suction members against the sides of the bath.

9. A steam enclosing bath cover apparatus as claimed in claim 6, wherein the container is provided on its underside with a track arrangement extending lengthwise thereof and carrying thereon a pair of flaps capable of undergoing reciprocating motion along the track arrangement, which flaps comprise suction means on faces thereof which are, in use, directed towards the sides of a said bath.

10. A steam enclosing bath cover apparatus as claimed in claim 9, wherein the flaps carry resilient biasing means for constraining them to lie against the underside of the container and are adapted for rotation each about a horizontal axis with respect to the underside of the container against tension in the respective resilient biasing means to bring the suction means into engagement with the sides of the bath.

* * * * *